United States Patent [19]

Jeschke

[11] Patent Number: 4,830,355

[45] Date of Patent: May 16, 1989

[54] SHEET TRANSFER APPARATUS FOR ROTARY PRINTING PRESSES

[75] Inventor: Willi Jeschke, Heidelberg, Fed. Rep. of Germany

[73] Assignee: Heidelberger Druckmaschinen Aktiengesellschaft, Heidelberg, Fed. Rep. of Germany

[21] Appl. No.: 107,492

[22] Filed: Oct. 8, 1987

[30] Foreign Application Priority Data

Oct. 9, 1986 [DE] Fed. Rep. of Germany ..... 3634400

[51] Int. Cl.[4] ..... B65H 29/68

[52] U.S. Cl. ..... 271/183; 271/231

[58] Field of Search ..... 271/183, 231

[56] References Cited

U.S. PATENT DOCUMENTS

| | | | |
|---|---|---|---|
| 3,190,644 | 6/1965 | Schwehel | 271/231 |
| 3,843,116 | 10/1974 | Jiruse | 271/183 |
| 3,938,800 | 2/1976 | Wirz | 271/93 |
| 4,030,727 | 6/1977 | Jeschke | 271/276 |
| 4,083,556 | 4/1978 | Schilling et al. | 271/204 |
| 4,421,028 | 12/1983 | Pollich | 101/240 |
| 4,479,645 | 10/1984 | Pollich | 271/183 |
| 4,561,645 | 12/1985 | Pollich | 271/195 |
| 4,693,462 | 9/1987 | Pollich | 271/231 X |

FOREIGN PATENT DOCUMENTS 3412180 1/1985 Fed. Rep. of Germany .

*Primary Examiner*—Richard A. Schacher
*Attorney, Agent, or Firm*—Nils H. Ljungman

[57] ABSTRACT

A sheet transfer system on a rotary printing press has an apparatus provided beneath the delivered sheets to slow down the sheets at their trailing end by means of conveyor belts which are guided by drive and deflector rollers, and between which, beneath the conveyor belt, there is a suction chamber, whereby even with a tight sheet sequence and high machine speed, a collision of the sheets during the deceleration process is prevented so that the sheets are slowed down and lowered onto the sheet delivery stack.

12 Claims, 4 Drawing Sheets

SHEET TRANSFER APPARATUS FOR ROTARY PRINTING PRESSES

BACKGROUND OF THE INVENTION

1. Field of the Invention:

The invention relates generally to a sheet delivery system on a rotary press, and more particularly to a sheet feed system with an apparatus provided underneath the delivered sheet to decelerate the sheet on its trailing end by means of conveyor belts which are guided by drive and deflection rollers, and between which there is a suction chamber beneath the conveyor belt.

2. Description of the Prior Art:

German Laid Open Patent Application No. DE-OS 24 60 504, which corresponds to U.S. Pat. No. 4,030,727, entitled "Sheet Transfer Device for Printing Presses" illustrates an apparatus of this type on which the delivered sheet is braked on its end by conveyor belts for which there is a suction chamber. As a result of the deceleration of the distributed sheet, the distance between it and the following sheet decreases so that, with sheets in close succession and a high machine speed, it is impossible to completely avoid collisions between the leading edge of the subsequent sheet and the trailing edge of the preceding sheet. This leads to a disruption in the distribution of the sheets and possibly to damage of the sheet itself.

German Laid Open Patent Application No. DE-OS 34 12 180 illustrates another embodiment in which there is also deflection rollers with a suction belt. In this case, the deflection rollers with the suction belt are pivoted downward via a pivot so that the sheet can drop down during the deceleration process toward the surface of the stack. The disadvantage of this configuration of the prior art is that the distributed sheet has to be bent in a vicinity of its trailing end to obtain sufficient suction action. With this configuration, therefore, it is not possible to process stiff material, e.g., cardboard, because a bending of the trailing end would not be possible. The end of the sheet would only be in contact with its edge on the suction belts so that no suction action or deceleration of the sheet could be achieved. Another significant disadvantage is that if the deceleration process should begin prematurely by means of the downward tipping of the suction belts, the trailing sheet end would be raised above the delivery level of the successive sheet so that the successive sheet might run into the end of the preceding sheet. It becomes impossible to positively prevent a collision of the two sheets when the ends of the sheets overlap during the deceleration process. Both of the afore-mentioned patents are incorporated by reference as if the entire contents thereof were fully set forth herein.

OBJECT OF THE INVENTION

The object of the present invention is to configure a sheet delivery with a deceleration apparatus so that even with sheets following close to one another and at a higher machine speed, collisions between sheets are prevented during the deceleration process.

SUMMARY OF THE INVENTION

The object is achieved by the invention in that the drive and deflector rollers are mounted on the journals of crank arms which are driven in synchronization with the sheet sequences so that the trailing end of the sheet is sucked in the upper position of the crank movement and that the sheet is slowed down after a partial rotation of the crank arm and lowered onto the stack of the sheet delivery. This solution slows down the trailing end of the sheet to be distributed, without changing its horizontal position. Thus, even stiff cardboard lies completely flat on the conveyor belts so that the full suction action can be used to slow down the sheet. In addition, the lowering of the sheet onto the sheet stack after release by the delivery grippers is assisted by the downward movement of the conveyor belts so that a gentle and uniform distribution of the sheets is assured, and their ends are moved out of the delivery plane of the next sheet immediately after being picked up by the conveyor belts. A collision of the two sheets can, therefor, be positively prevented.

One embodiment of the invention resides broadly in a sheet transfer apparatus for a rotary printing press for decelerating printed sheets. The sheet transfer apparatus comprises: a first and a second roller having a conveyor belt connected therebetween. The conveyor belt has an uppermost surface, in use, for receiving and decelerating sheets from sheet delivery equipment. Vacuum producing equipment is disposed beneath and supplies vacuum to the uppermost surface, in use, of the conveyor belt. The conveyor belt has an arrangement for passing the vacuum from the vacuum producing equipment therethrough to hold a sheet disposed thereabove. A first crank is attached to the first roller for moving the first roller in a first path. A second crank is attached to the second roller for moving the second roller in a second path. An arrangement for synchronizing movement of the first and second cranks with a trailing edge of a sheet being received from sheet delivery equipment at an upper position of at least one of the cranks. An arrangement for releasing a held and decelerated sheet at a position of at least one of the cranks lower than the upper position whereby a released sheet is lowered to a sheet delivery stack.

Another embodiment of the invention resides broadly in a printing press with a sheet transfer device comprising a conveyor belt apparatus having at least a portion of a top surface for making contact at given portions of a sheet being transferred from sheet delivery equipment. A suction-producing apparatus is disposed below and in the vicinity of the portion of the top surface of the conveyor belt apparatus for making contact with a sheet. The conveyor belt apparatus has equipment for transferring vacuum from the suction-producing apparatus to a sheet being transferred by and being disposed on the conveyor belt apparatus, the vacuum transferring equipment for transferring the vacuum to a top surface of the conveyor belt apparatus for holding the given portions of the sheet on the conveyor belt apparatus and for slowing the sheet down when held on the top surface. Equipment for moving at least the top surface of the conveyor belt apparatus up and down and for lowering at least the portions of the top surface, for contacting portions of a sheet, from a substantially horizontal position for receiving a sheet from sheet delivery equipment to a substantially horizontal position for transferring a sheet to a delivery pile for having sheets stacked one above the other. The suction-producing apparatus has a source for producing vacuum for at least a time when a portion of a sheet is in contact with the top surface of the conveyor belt apparatus.

DESCRIPTION OF THE PREFERRED EMBODIMENTS

Figure 1:
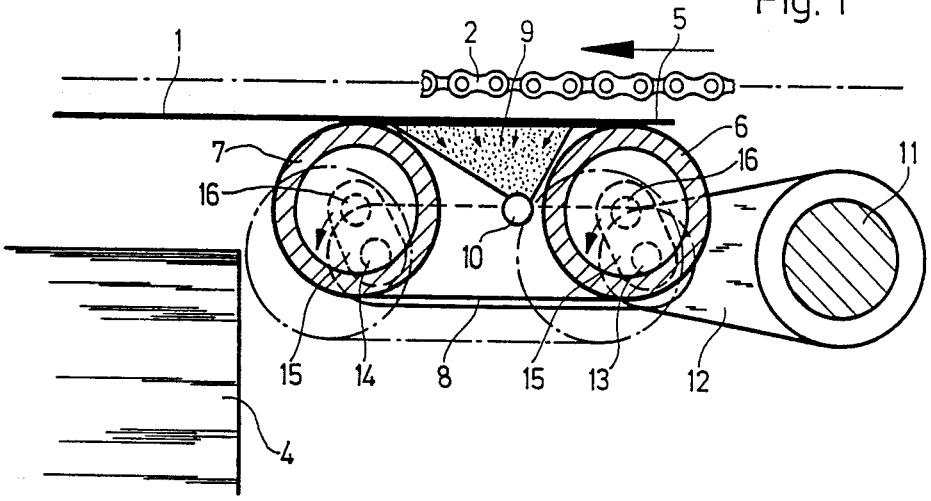
FIG. 1 shows a lateral view of the deceleration apparatus in the pick-up position for the sheet end.

On rotary printing presses, the printed sheets 1 are transported, via delivery chains 2 and the gripper arms 3 attached to them, to the sheet stacked 4. Examples of delivery chains 2 and gripper arms 3 with associated equipment are found in U.S. Pat. No. 4,479,645, entitled "Sheet Delivery For Rotary Printing Machines" and U.S. Pat. No. 4,083,556, entitled "Sheet Delivery For Rotary Printing Machines", both of which are assigned to the same assignee as the instant application. These patents are incorporated herein by reference as if set forth herein in their entirety.

Below the transported sheet 1 there is an apparatus to slow down the sheet 1 on its trailing end 5, which apparatus is driven at a lower speed than the sheet being transported. There are preferably several of these devices over thew width of the sheet, and they can be applied to unprinted portions of the sheet.

The deceleration apparatus shown comprises a drive roller 6 and a deflection roller 7 between which there is a conveyor belt 8 which can either be perforated or can comprise two narrow round cords. Beneath the upper conveyor belt 8, there is a suction chamber 9 which, as soon as the sheet end 5 moves over the deceleration apparatus, is activated with a vacuum so that the sheet end 5 is sucked onto the conveyor belts 8, the lower speed of which decelerates the sheet 1 to be distributed. The suction air is delivered to the suction chambers 9 by means of a central air supply via the connection 10.

Figure 2:
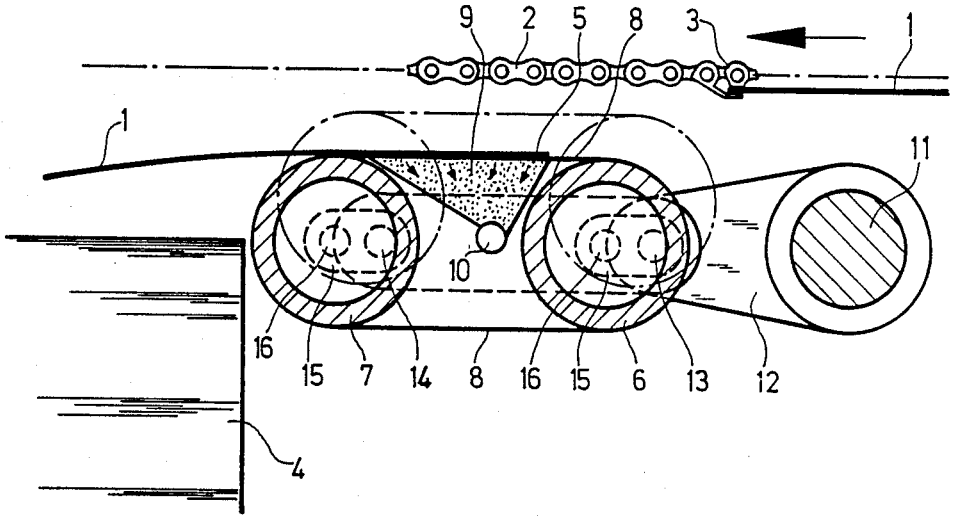
FIG. 2 shows a lateral view of the deceleration apparatus in a lowered position.

In the embodiment shown in FIGS. 1 and 2, there is a transverse axle 11 which is connected between the side frames of the machine, to which are attached levers or cantilevers 12 which are supported thereby. Typically, each of the cantilevers 12, extending from the traverse axle 11, supports an individual one of the devices shown in each of the Figures. On the levers 12 there are bearings 13 for the drive rollers 6 and bearings 14 for the deflector rollers 7. Alternatively, a second cantilever arrangement could support the bearings 14 for each of the deflector rollers 7. However, preferably both rollers are supported by their own cantilever 12 such that the cantilevers 12 would also support the bearings 14 and thus, the deflector rollers 7. Mounted on the bearings 13, 14 are rotating crank arms 15. The drive rollers 6 and deflector rollers 7 are mounted on the journals 16 of the crank arms 15.

If the crank arms 15 are now driven in the vicinity of their bearings 13, 14, e.g., by a motor in the counterclockwise direction, and if there is a connecting link between the bearings 13, 14 on the crank arms 15, e.g., in the form of a toothed belt 15A, then the two crank arms 15 move parallel to one another with a circular motion. The speed of rotation of the crank arms 15 is here designed so that the journals 16 are moved into their top position when the end of the sheet to be distributed is in the vicinity of the deceleration apparatus. At the same time, a vacuum is produced in the suction chamber 9 so that the sheet end is sucked onto the conveyor belt 8.

In one embodiment of the invention, the rollers 6 and 7 are firmly attached to its corresponding crank arm 15 and rotate and turn therewith. In an alternative embodiment, the drive roller 6 can also be coupled with an electric motor so that the drive. roller 6, the defection roller 7 and the conveyor belt 8 are driven thereby. The speed of the electric motor is controlled as a function of the corresponding machine speed so that the conveyor belt 8 is always driven at a speed which is preferably at most, lower than the delivery speed of the sheet 1. If the end 5 of the sheet 1 is then sucked onto the belt, the sheet is decelerated to the slower speed. A a result of the rotational movement of the crank arms 15 in the direction of the arrow, the sheets 1 are slowed down and lowered during the deceleration process. After a partial rotation of the crank arm 15, as shown in FIG. 2, the decelerated and lowered sheet 1 is deposited on the stack 4, whereby the remaining reduced speed assures a continued sliding of the sheet 1 until it hits the front stop, not shown in the figures, but shown as 19 in U.S. Pat. No. 4,083,556 supra, which is incorporated by reference. Towards or at the end of the deceleration process, the vacuum in the suction chambers 9 is preferably turned off so that the end 5 of the sheet 1 is released.

As a result of the movement of the conveyor belt 8 parallel to the plane of the sheet, the end 5 of the sheet 1 is not deformed and is thus subjected to the full suction action of the suction air so that even thick and stiff sheet material with high sheet weights can be securely slowed down and distributed.

Figure 3:
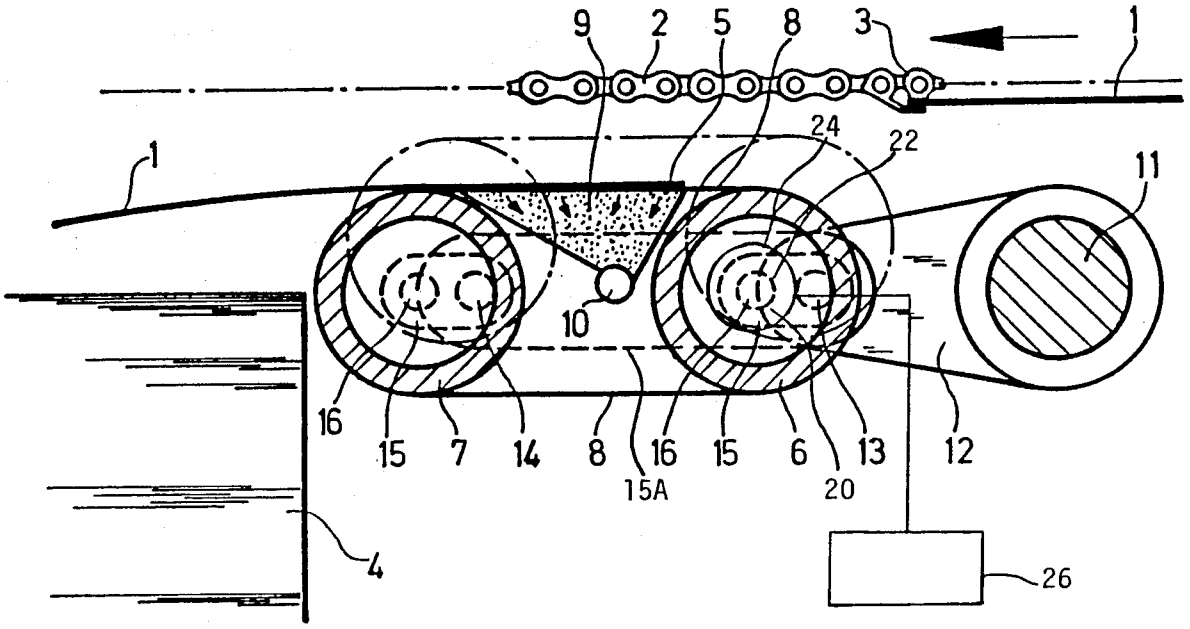
FIG. 3 shows a lateral view of the deceleration apparatus with a separate motor for driving a roller.

Referring now to FIG. 3, an electric motor 20 is preferably disposed in one embodiment of the invention inside the drive roller 6 for driving the conveyor belt 8 and the deflector roller 7. The electric motor 20 may have its rotor 22 fastened through the journals 16, and its stator 24 attached to the crank arm 15. An electric power transfer arrangement such as a slip ring or other arrangement, well known in the prior art, can be used to transfer electricity to the electric motor 20. A motor speed control 26 is connected to the electric power transfer arrangement to control the speed of the electric motor 20, thereby to adjust the speed of the motor to conform to parameters of the speed of the printing press and the size, weight, shape, etc. of the sheets.

Figure 4:
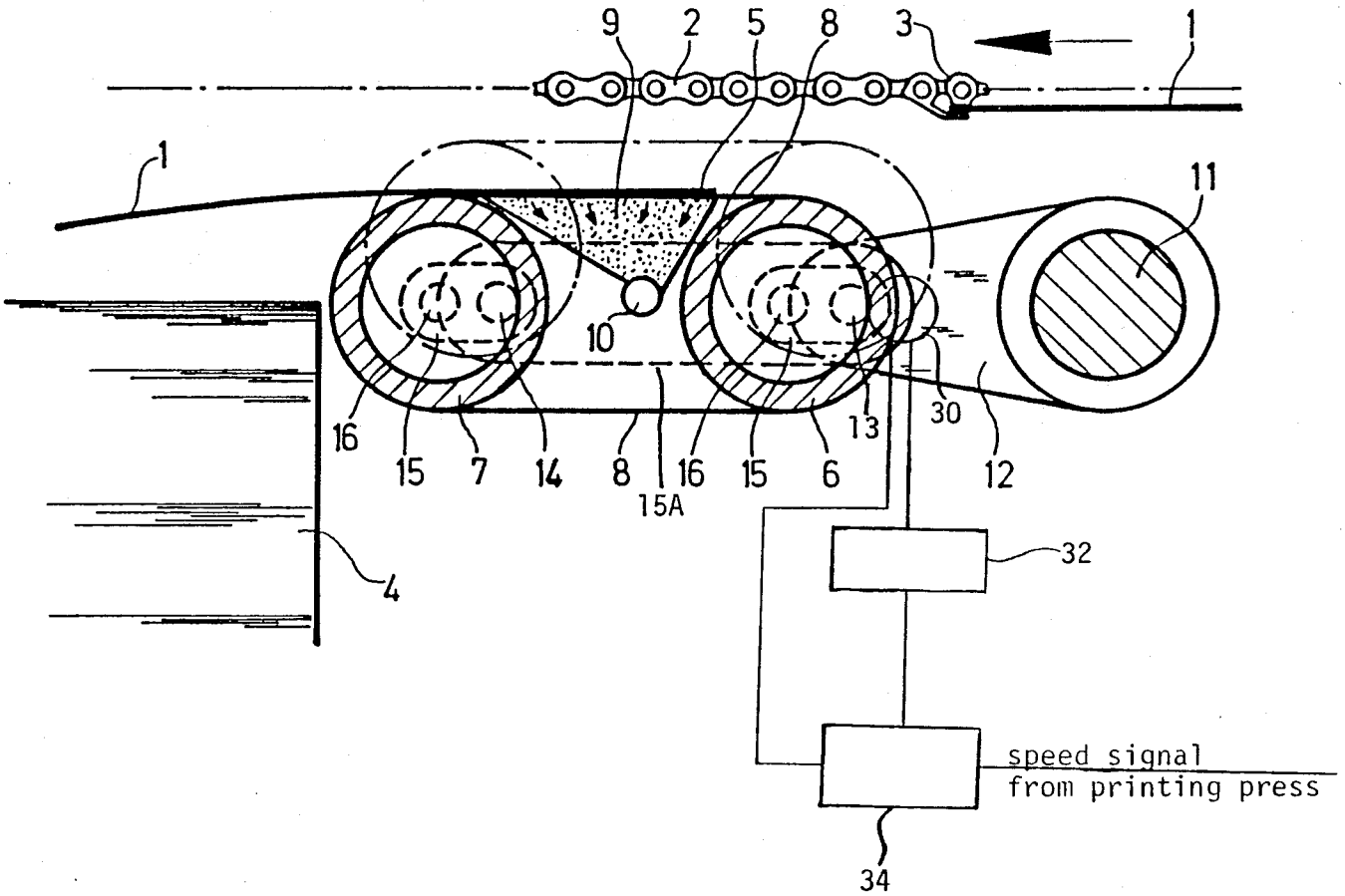
FIG. 4 shows a lateral view of the deceleration apparatus with a separate motor for driving a crank arm.

Referring to FIG. 4, a second electric motor 30 is preferably attached in one embodiment of the invention to the cantilever 12 to drive the crank arm 15. This second electric motor may also have a speed control 32 connected thereto for adjusting the speed of the crank arm 15. A synchronizing circuit 34 for synchronizing the speed of the sheet delivery system with the sheets being delivered by the delivery chains 2 from the printing press is connected to receiving a signal from the printing press and also connected to receiving a signal from the motor 30 and delivering a synchronization signal to the motor speed control 32. Alternatively, the crank 15 can be synchronized by being directly driven by a shaft and gears from the printing press to positively and mechanically provide this synchronization. Both the speed controls 26 and 32 are preferably electronic but may also be solely electrical.

Figure 5:
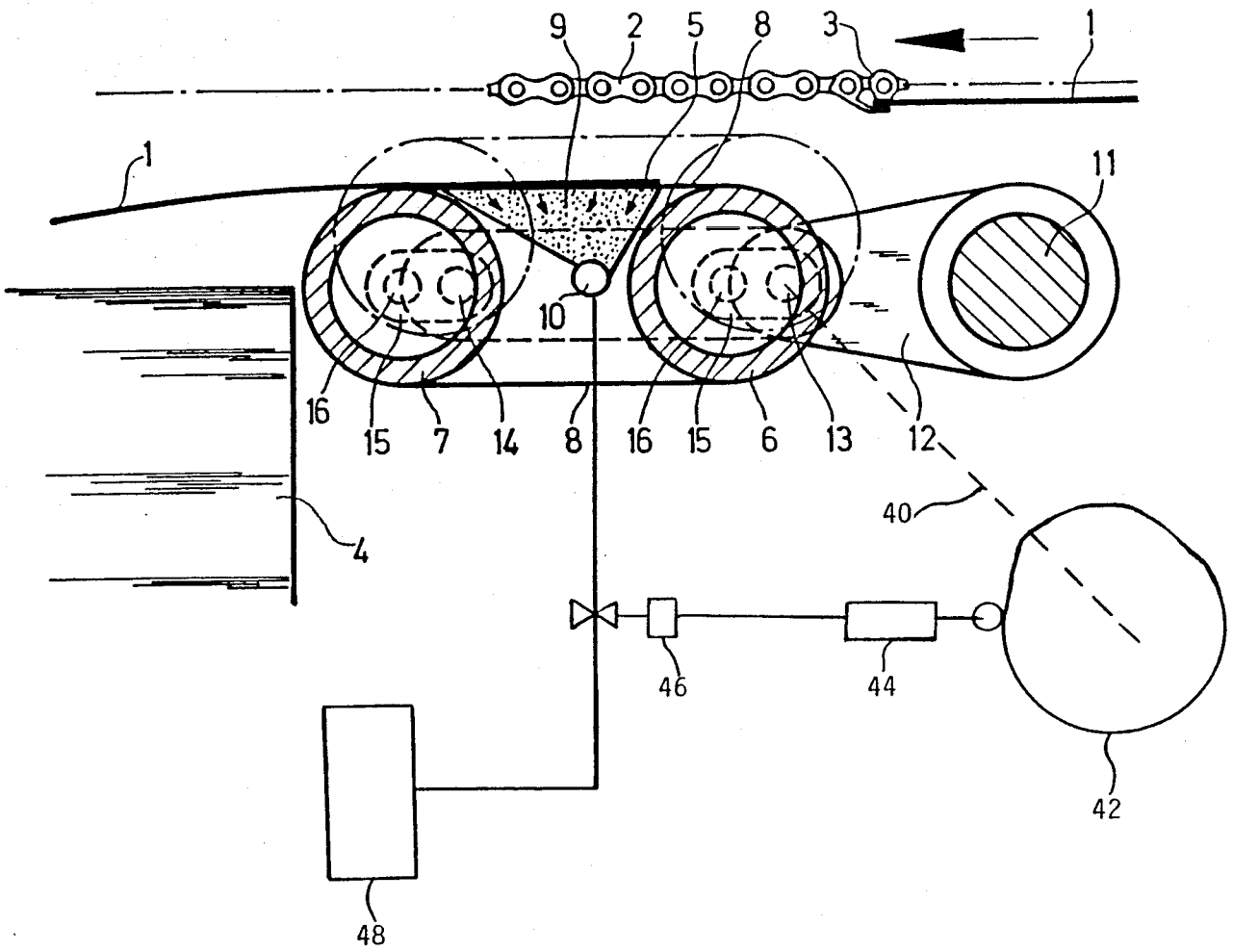
FIG. 5 shows a lateral view of the deceleration apparatus with a vacuum control system.

Referring now to FIG. 5 wherein a schematic representation is shown of an arrangement for turning the vacuum in the vacuum chamber 9 and the connection 10, on and off. A shaft 40 connects the crank arm 15 with a cam 42 with at least one lobe thereon for turning the vacuum in the vacuum chamber on and off. A cam follower switch assembly 44 is switched on and off by the action of the rotation of the crank arm 15 and the cam 42 therewith. The placement of the lobe and its duration may depend on operating factors of the printing press, such as, speed, delivery rate of paper, type of paper used, weight of the paper, thickness thereof, shape, etc. However, preferably the cam should be able to handle a large spread of conditions without having to be changed. The cam follower switch assembly 44 controls a solenoid valve 46 which connects and disconnects a source of vacuum 48 from the vacuum connection 10, such that, the sheet 1 is held against the conveyor belt 8 for an appropriate time period for the slowing of the sheet 1 during transfer.

In all the Figures, the drive roller 6 preferably is very narrow, that is, wide enough only to hold the paper 1 at an unprinted or dry position thereof, whereby the ink is not smeared during transfer. The drive rollers 6, the deflector rollers 7 and the belt 8, with their corresponding suction chamber 9, are preferably in the order of 10 to 20 millimeters in width in all the embodiments shown. These arrangements could be made narrower or wider if special conditions exist in some embodiments of the invention. Typically, the lines connecting the vacuum between the solenoid valve 46 and the connection 10 have flexible portions which move with the suction chamber 9.

In the various Figures, the suction chamber 9 moves with the conveyor belt 8 and is preferably connected, by means not shown, to the journals or bearings 16 or the crank arms 15 to move therewith.

At the topmost position of the conveyor belt 8, the linear horizontal velocity of the top surface thereof is greatest, being the addition of the rotational velocity of the rollers 6 and 7 and the crank velocity of the cranks 15. As the crank arms 15 rotate from a 12 o'clock position, the horizontal velocity of the upper surface of the belt 8 decreases to a lower value during transfer operation at the 9 o'clock position thereof. This function contributes to an orderly deceleration of the sheet 1 from the upper most position of the upper most surface of the belt 8 to the position when the sheet 1 leaves the belt 8.

The invention as described hereinabove in the context of the preferred embodiments is not to be taken as limited to all of the provided details thereof, since modifications and variations thereof may be made without departing from the spirit and scope of the invention.

What is claimed is:

1. A sheet transfer apparatus for a rotary printing press for decelerating printed sheets, said sheet transfer apparatus comprising:

a first and a second roller having a conveyor belt connected therebetween;

said conveyor belt having an uppermost surface, in use, for receiving and decelerating sheets from sheet delivery means;

vacuum means being disposed beneath and supplying vacuum to said uppermost surface, in use, of said conveyor belt;

said conveyor belt having means for passing the vacuum from said vacuum means therethrough to hold a sheet disposed thereabove;

first crank means being attached to said first roller for moving said first roller in a first path;

second crank means being attached to said second roller for moving said second roller in a second path;

means for synchronizing movement of said first and second crank means with a trailing edge of a sheet being received from sheet delivery means at an upper position of at least one of said cranks; and means for releasing a held and decelerated sheet at a position of at least one of said cranks lower than said upper position whereby a released sheet is lowered to a sheet delivery stack.

2. The apparatus according to claim 1, including means for driving said first and said second crank means in synchronism and parallel to one another whereby both crank means reach an uppermost and other corresponding positions simultaneously.

3. The apparatus according to claim 1, including means for connecting said first and second cranks to dispose said uppermost surface, in use, substantially parallel to a sheet being received from said sheet delivery means.

4. The apparatus according to claim 3, including a first motor connected to drive said crank means.

5. The apparatus according to claim 4, including a second motor for driving one of said rollers and said belt independently of said first motor; and means for controlling the speed of said second motor as a function of the speed of the printing press.

6. The apparatus according to claim 1, including independent motor means for driving said rollers independently with respect to their crank means; and means for controlling the speed of said independent motor means as a function of the speed of the printing press.

7. In a printing press, a sheet transfer device comprising:

conveyor belt means having at least a portion of a top surface for making contact at given portions of a sheet being transferred from sheet delivery means;

suction-producing means disposed below and in the vicinity of the portion of said top surface of said conveyor belt means for making contact with a sheet;

said conveyor belt means having means for transferring vacuum from said suction-producing means to a sheet being transferred by and being disposed on said conveyor belt means, said vacuum transferring means for transferring the vacuum to a top surface of said conveyor belt means for holding said given portions of said sheet on said conveyor belt means and for slowing said sheet down when held on said top surface; and means for moving at least said top surface of said conveyor belt means up and down and for lowering at least the portions of said top surface, for contacting portions of a sheet, from a substantially horizontal position for receiving a sheet from said sheet delivery means to a substantially horizontal position for transferring a sheet to a delivery pile for having sheets stacked one above the other; and said suction-producing means having a source for producing vacuum for at least a time when a portion of a sheet is in contact with said top surface of said conveyor belt means.

8. The device according to claim 7, wherein said conveyor belt means has means for slowing the horizontal speed of the top surface of the belt from a substantial maximum speed at the position for receiving a sheet to a lower speed at the position for transferring a sheet to a delivery pile.

9. The device according to claim 7, wherein said means for moving said top portion of said top surface of said conveyor belt means includes means for disposing said portion of said top surface substantially horizontally between said position for receiving a sheet and said position for transferring a sheet to a delivery pile.

10. The device according to claim 7, wherein said conveyor belt means comprises:

a conveyor belt being disposed between a first and a second roller;

first crank means being attached to said first roller for moving said first roller in a circular path;

second crank means being attached to said second roller for moving said second roller in a circular path; and means for synchronizing movement of said first and second crank means.

11. The device according to claim 10, including means of synchronizing speed of said first and said second crank means with speed of delivery of sheets.

12. The device according to claim 11, including means for positively synchronizing the first and second crank means to position the crank means and said conveyor belt means to suck a trailing edge of a sheet at an upper portion of crank movement to said portion of said top surface of said conveyor belt means for making contact with said given portions of said sheet and whereby a held sheet is slowed down after a partial rotation of said first and second crank means.

* * * * *